US008624789B2

(12) United States Patent
Oh et al.

(10) Patent No.: US 8,624,789 B2
(45) Date of Patent: Jan. 7, 2014

(54) APPARATUS FOR ADJUSTING AN INCLINATION ANGLE IN AN ANTENNA

(75) Inventors: Gun-Seok Oh, Incheon (KR); Byung-Il Oh, Gyeonggi-Do (KR); Byung-Hwan Kim, Incheon (KR)

(73) Assignee: Ace Antenna Corp., Incheon (KR)

( * ) Notice: Subject to any disclaimer, the term of this patent is extended or adjusted under 35 U.S.C. 154(b) by 396 days.

(21) Appl. No.: 12/743,336

(22) PCT Filed: Dec. 18, 2007

(86) PCT No.: PCT/KR2007/006627

§ 371 (c)(1),
(2), (4) Date: May 17, 2010

(87) PCT Pub. No.: WO2009/069842

PCT Pub. Date: Jun. 4, 2009

(65) Prior Publication Data

US 2011/0134005 A1 Jun. 9, 2011

(30) Foreign Application Priority Data

Nov. 30, 2007 (KR) ..... 10-2007-0123291

(51) Int. Cl.
*H01Q 3/08* (2006.01)

(52) U.S. Cl.
USPC ..... 343/757; 343/763; 343/766

(58) Field of Classification Search
USPC ..... 343/757, 763, 766
See application file for complete search history.

(56) References Cited

U.S. PATENT DOCUMENTS

2004/0155828 A1* 8/2004 Heinz et al. ..... 343/757
2004/0209572 A1 10/2004 Thomas
2006/0066494 A1* 3/2006 Trejtnar et al. ..... 343/757
2008/0198080 A1* 8/2008 Duan ..... 343/758

FOREIGN PATENT DOCUMENTS

KR 1020070049459 5/2007
WO WO 2006/128339 A1 * 12/2005 ..... H01Q 3/32
WO 2006128339 A1 12/2006
WO WO 2006128339 A1 * 12/2006

OTHER PUBLICATIONS

International Search Report dated Aug. 25, 2008, based on PCT/KR2007/006627.

* cited by examiner

*Primary Examiner* — Douglas W Owens
*Assistant Examiner* — Collin Dawkins
(74) *Attorney, Agent, or Firm* — Edwards Wildman Palmer LLP

(57) ABSTRACT

An apparatus for adjusting an inclination angle of an antenna using a rotatory power is disclosed, wherein a remote control unit is easily combined with the apparatus. The apparatus in an antenna having a phase shifter includes a power delivering member connected to the phase shifter, and a driving member combined with the power delivering member, and for providing a power to the power delivering member. Here, an inserting section is formed at a part of outside surfaces of the driving member, a remote control unit is inserted into the inserting section and rotates the driving member, and the power delivering member rotates in response to the power provided from the driving member. Accordingly, any given member is not removed when the remote control unit is combined with the apparatus. As a result, the remote control unit may be easily combined with the apparatus, and any member is not lost.

11 Claims, 5 Drawing Sheets

APPARATUS FOR ADJUSTING AN INCLINATION ANGLE IN AN ANTENNA

CROSS-REFERENCES TO RELATED APPLICATIONS

This application is a U.S. national phase application, pursuant to 35 U.S.C. §371 of PCT/KR2007/006627, filed Dec. 18, 2007, designating the United States, which claims priority to Korean Application No. 10-2007-0123291, filed Nov. 30, 2007. The entire contents of the aforementioned patent applications are incorporated herein by this reference.

TECHNICAL FIELD

Example embodiment of the present invention relates to an inclination angle adjusting apparatus for adjusting an inclination angle of an antenna using a rotatory power, wherein a remote control unit is easily combined with the inclination angle apparatus.

BACKGROUND ART

An antenna transmits or receives an electromagnetic wave by outputting a certain beam, and thus the antenna must be able to adjust direction of the beam. An apparatus of adjusting the direction of the beam is an inclination angle adjusting apparatus.

FIG. 1 is a perspective view illustrating a common first inclination angle adjusting apparatus.

In FIG. 1, the first inclination angle adjusting apparatus 100 includes a power delivering member 102, a body 104 and a driving member 106.

In case that a user rotates the driving member 106 using his hand, the power delivering member 102 moves linearly in response to the rotation of the driving member 106. As a result, a phase shifter (not shown) connected to the power delivering member 102 controls phase of a RF signal inputted from an outside, thereby adjusting an inclination angle of the antenna. Here, a thread 108 is formed on the power delivering member 102, and a structure (not shown) corresponding to the thread 108 is formed on an internal surface of the driving member 106 so that the power delivering member 102 moves in response to operation of the driving member 106.

In the above first inclination angle adjusting apparatus 100, the driving member 106 may be moved by an external force such as quake, impact, etc despite a user does not rotate the driving member 106. Accordingly, to prevent this moving phenomenon, the first inclination angle adjusting apparatus 100 fixes the driving member 106 using a cap 110 when the inclination angle is not adjusted.

In case that the user wants to rotate the driving member 106 using a remote control unit such as a motor, etc, the cap 110 is separated from the driving member 106, and then the remote control unit is combined with the driving member 106. As a result, it is inconvenient to separate the cap 110, and the separated cap 110 may be lost.

FIG. 2 is a perspective view illustrating a common second inclination angle adjusting apparatus.

In FIG. 2, the second inclination angle adjusting apparatus 200 includes a power delivering member 202, a body 204 and a driving member 206.

The driving member 206 is combined with a thread 216 formed on an end of the power delivering member 202 so that the driving member 206 is fixed to the power delivering member 202. Here, the power delivering member 202 moves linearly according as a user pushes or pulls the driving member 206, and a phase shifter connected to the power delivering member 202 adjusts an inclination angle of the antenna in response to the moving.

The body 204 houses the power delivering member 202, thereby protecting the power delivering member 202.

Power delivering member fixing members, i.e. a nut 208, a bush 210 and a fixing member 212 fix the power delivering member 202 so that the power delivering member 202 is not separated from the body 204 by an external force such as quake, etc.

However, in case of controlling the second inclination angle adjusting apparatus 200 using a remote control unit, the power delivering member fixing members and the driving member 206 must be separated before the remote control unit is combined with the power delivering member 202. As a result, inconvenient process of combining or separating the power delivering member fixing members and the driving member 206 should be performed. In addition, the separated members may be lost.

DISCLOSURE OF INVENTION

Technical Problem

Accordingly, the present invention is provided to substantially obviate one or more problems due to limitations and disadvantages of the related art.

Example embodiment of the present invention provides an inclination angle adjusting apparatus for combining easily with a remote control unit and preventing loss of a specific member.

Another example embodiment of the present invention provides an inclination angle adjusting apparatus for fixing easily a driving member to a body or separating easily the driving member from the body by using a simple method of combining a hook member with a cylindrical home or an imperfect cylindrical home.

Technical Solution

An inclination angle adjusting apparatus in an antenna having a phase shifter according to one example embodiment of the present invention includes a power delivering member connected to the phase shifter; and a driving member combined with the power delivering member, and configured to provide a power to the power delivering member. Here, a first inserting section is formed on a part of outside surfaces of the driving member, a remote control unit is inserted into the first inserting section of the driving member and rotates the driving member, and the power delivering member rotates in response to the power provided from the driving member.

The inclination angle adjusting apparatus further includes a body configured to house the power delivering member, wherein the driving member is combined with the body.

At least one hook member is formed on an end of the driving member, and a cylindrical home and imperfect cylindrical homes are formed on an outside surface of the body. Here, the driving member is rotated on the body when the hook member is combined with the cylindrical home, and the driving member is fixed to the body when the hook member is combined with the imperfect cylindrical home.

The inclination angle adjusting apparatus further includes a fixing member combined with an end of the body so that the hook member is not separated from the imperfect cylindrical home by an outside force when the hook member is combined with the imperfect cylindrical home.

The driving member has a projection member, and a second inserting section is formed on an end of the power delivering member, and wherein the projection member is inserted into the second inserting section when the driving member is combined with the power delivering member.

The driving member has cylindrical shape, and the projection member is projected from an internal surface of the driving member.

The projection member has polygon shape, and the second inserting section has shape corresponding to the projection member.

The first inserting section has polygon shape.

At least one hook member is formed on an end of the driving member, and a cylindrical home and imperfect cylindrical homes are formed on an outside surface of the body. Here, the driving member is rotated on the body when the hook member is combined with the cylindrical home, the driving member is fixed to the body when the hook member is combined with the imperfect cylindrical home, and the hook member combined with the imperfect cylindrical home is automatically moved on the cylindrical home when the remote control unit is inserted into the first inserting section of the driving member.

At least one sliding protection projection member is formed on the outside surface of the driving member.

A thread is formed on a part of an outside surface of the power delivering member, and an indicating member for indicating change degree of an inclination angle is disposed on the thread.

The rotatory power delivered from the driving member is provided to a phase shifter through the power delivering member, and the phase shifter adjusts an inclination angle of the antenna using the provided rotatory power.

The phase shifter includes a gear worm combined with the power delivering member; and a gear wheel connected to the gear worm and configured to rotate in accordance with operation of the gear worm. Here, the inclination angle of the antenna is adjusted in accordance with rotation of the gear wheel.

An inclination angle adjusting apparatus in an antenna according to another example embodiment of the present invention includes a body, wherein a cylindrical home and at least one imperfect cylindrical home are formed on the body; and a driving member configured to have one or more hook member. Here, the driving member is rotated on the body when the hook member is combined with the cylindrical home, and the driving member is fixed to the body when the hook member is combined with the imperfect cylindrical home.

The inclination angle adjusting apparatus of claim 14 further includes a power delivering member combined with a phase shifter, and configured to deliver a rotatory power in accordance with rotation of the driving member to the phase shifter; and a fixing member combined with an end of the body so that the hook member is not separated from the imperfect cylindrical home by an outside force when the hook member is combined with the imperfect cylindrical home, wherein the body houses the power delivering member.

The driving member has a projection member, and an inserting section is formed on an end of the power delivering member. Here, the projection member is inserted into the inserting section of the power delivering member when the driving member is combined with the power delivering member.

The projection member has polygon shape, and the inserting section has shape corresponding to the projection member.

At least one sliding protection projection member is formed on the outside surface of the driving member.

Advantageous Effects

In an inclination angle adjusting apparatus of the present invention, an inserting section is formed on an outside surface of a driving member, wherein a remote control unit is inserted into the inserting section. Accordingly, certain members may not be removed when the remote control unit is combined with the inclination angle adjusting apparatus. As a result, the remote control unit may be easily combined with the inclination angle adjusting apparatus, and certain members may not be lost.

In an inclination angle adjusting apparatus according to another example embodiment of the present invention, a driving member is fixed to a body or separated from the body through a simple method of combining a hook member with a cylindrical home or an imperfect cylindrical home. That is, extra members for fixing the inclination angle adjusting apparatus are not needed, and the driving member may be easily fixed to the body through the above simple method.

BRIEF DESCRIPTION OF THE DRAWINGS

Example embodiments of the present invention will become more apparent by describing in detail example embodiments of the present invention with reference to the accompanying drawings, in which.

MODE FOR THE INVENTION

Figure 1:
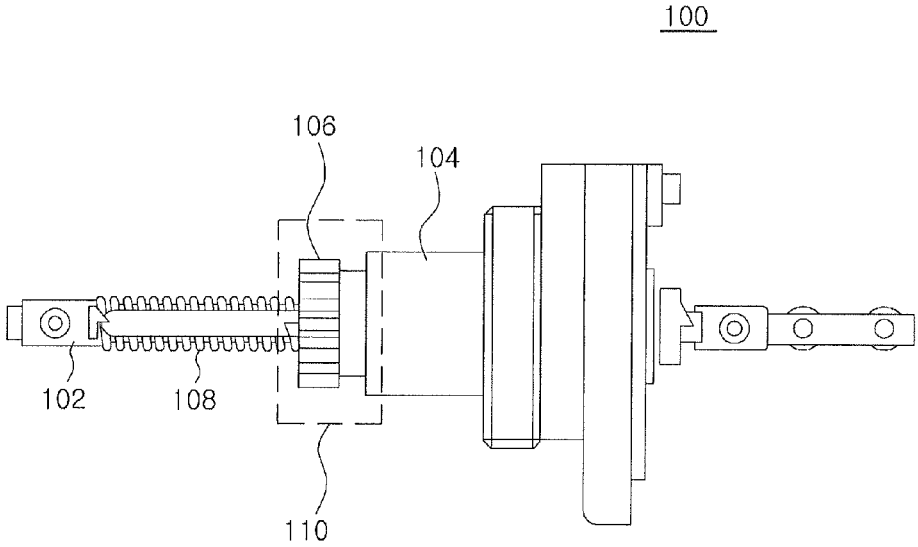
FIG. 1 RELATED ART
FIG. 1 is a perspective view illustrating a common first inclination angle adjusting apparatus.
Figure 2:
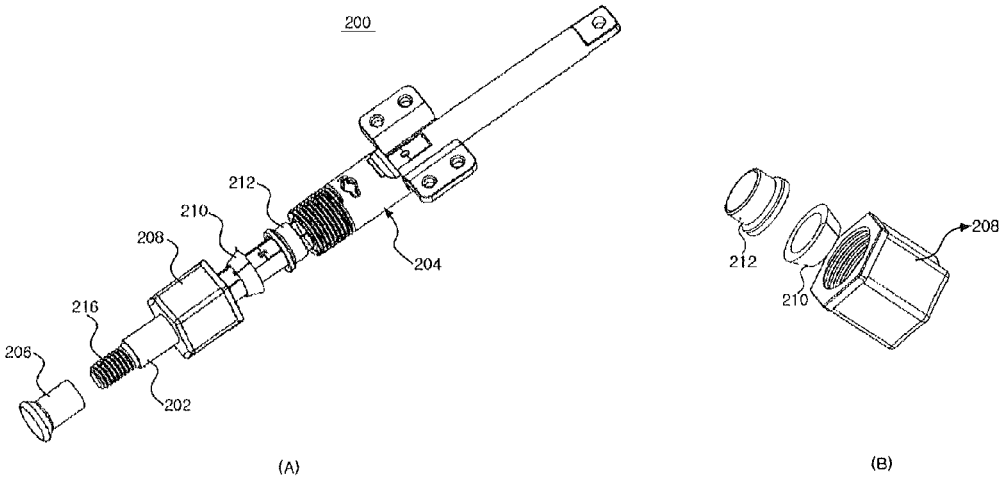
FIG. 2 RELATED ART
FIG. 2 is a perspective view illustrating a common second inclination angle adjusting apparatus.

Example embodiments of the present invention are disclosed herein. However, specific structural and functional details disclosed herein are merely representative for purposes of describing example embodiments of the present invention, however, example embodiments of the present invention may be embodied in many alternate forms and should not be construed as limited to example embodiments of the present invention set forth herein.

Accordingly, while the invention is susceptible to various modifications and alternative forms, specific embodiments thereof are shown by way of example in the drawings and will herein be described in detail. It should be understood, however, that there is no intent to limit the invention to the particular forms disclosed, but on the contrary, the invention is to cover all modifications, equivalents, and alternatives falling within the spirit and scope of the invention. Like numbers refer to like elements throughout the description of the figures.

It will be understood that, although the terms first, second, etc. may be used herein to describe various elements, these elements should not be limited by these terms. These terms are only used to distinguish one element from another. For example, a first element could be termed a second element, and, similarly, a second element could be termed a first element, without departing from the scope of the present invention. As used herein, the term "and/or" includes any and all combinations of one or more of the associated listed items.

It will be understood that when an element is referred to as being "connected" or "coupled" to another element, it can be directly connected or coupled to the other element or intervening elements may be present. In contrast, when an element is referred to as being "directly connected" or "directly coupled" to another element, there are no intervening elements present. Other words used to describe the relationship between elements should be interpreted in a like fashion (i.e., "between" versus "directly between", "adjacent" versus "directly adjacent", etc.).

The terminology used herein is for the purpose of describing particular embodiments only and is not intended to be limiting of the invention. As used herein, the singular forms "a", "an" and "the" are intended to include the plural forms as well, unless the context clearly indicates otherwise. It will be further understood that the terms "comprises", "comprising, ", "includes" and/or "including", when used herein, specify the presence of stated features, integers, steps, operations, elements, and/or components, but do not preclude the presence or addition of one or more other features, integers, steps, operations, elements, components, and/or groups thereof.

Unless otherwise defined, all terms (including technical and scientific terms) used herein have the same meaning as commonly understood by one of ordinary skill in the art to which this invention belongs. It will be further understood that terms, such as those defined in commonly used dictionaries, should be interpreted as having a meaning that is consistent with their meaning in the context of the relevant art and will not be interpreted in an idealized or overly formal sense unless expressly so defined herein.

Figure 3:
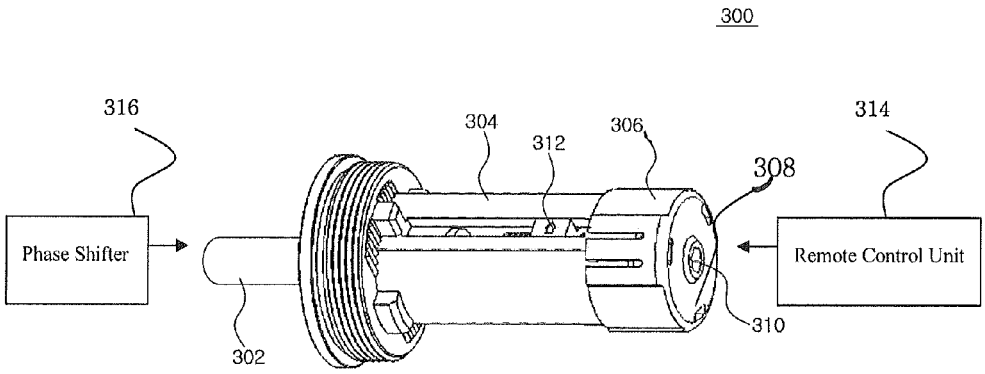
FIG. 3 is a perspective view illustrating an inclination angle adjusting apparatus in an antenna according to one example embodiment of the present invention.

FIG. 3 is a perspective view illustrating an inclination angle adjusting apparatus in an antenna according to one example embodiment of the present invention.

In FIG. 3, the inclination angle adjusting apparatus 300 of the present embodiment adjusts an inclination angle of the antenna, and is connected to a phase shifter 316 as described below. Particularly, the inclination angle adjusting apparatus 300 delivers a rotatory power to the phase shifter. The phase shifter 316 changes phase of a RF signal inputted from an outside device (not shown) in accordance with the delivered rotatory power, thereby adjusting direction of a beam outputted from the antenna. This will be described in detail with reference to accompanying drawing.

The inclination angle adjusting apparatus 300 includes a power delivering member 302, a body 304, a driving member 306 and an indicating member 312.

The power delivering member 302 is connected to the phase shifter 316, and delivers the rotatory power generated by the driving member 306 to the phase shifter 316. Here, connection of the power delivering member 302 and the phase shifter 316 is not shown, but may be variously modified as long as the power delivering member 302 delivers the rotatory power to the phase shifter.

The body 304 houses the power delivering member 302, thereby protecting the power delivering member 302. A scale for indicating change degree of the inclination angle may be indicated on a part of the body 304, preferably a part corresponding to the indicating member 312.

The driving member 306 combines with the body 304 so that the driving member 306 is rotated on the body 304. That is, the driving member 306 combines with the body 304 so that a user can rotate the driving member 306 using his hands. In addition, a projection member combined with the power delivering member 302 is formed on an internal surface of the driving member 306 as described below. Accordingly, in case that the user rotates the driving member 306, the rotatory power is generated from the driving member 306. The generated rotatory power is delivered to the power delivering member 302 through the projection member.

An inserting section 310 is formed on an outside surface of the driving member 306 as shown in FIG. 3.

In the above description, the user rotates directly the driving member 306, but the driving member 306 may be rotated by a remote control unit, e.g. a motor. In this case, the remote control unit 314 rotates the driving member 306 under the condition that the remote control unit is inserted into the inserting section 310 of the driving member 306.

In one example embodiment of the present invention, the inserting section 310 of the driving member 306 may have polygon shape so that the rotatory power of the remote control unit is more much delivered.

The driving member 306 has cylindrical shape as shown in FIG. 3. Here, a sliding protection projection member 308 may be formed on an outside surface of the driving member 306 so that the user's hand does not slide when the user rotates the driving member 306 using his hand.

Figure 8:
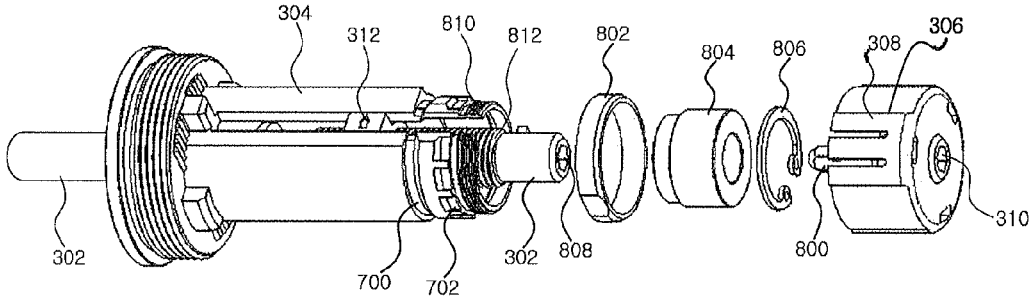
FIG. 8 is a perspective view illustrating an inclination angle adjusting apparatus according to one example embodiment of the present invention.

The indicating member 312 indicates change degree of the inclination angle, and moves in response to the rotation of the driving member 306. In this case, a user detects change degree of the inclination angle by verifying location of the indicating member 312 through scale indicated at the body 304. In one example embodiment of the present invention, a first thread is formed on a part of the power delivering member 302 as shown in FIG. 3 and FIG. 8, and a second thread corresponding to the first thread is formed on an internal surface of the indicating member 312.

In brief, the inclination angle adjusting apparatus 300 of the present embodiment generates the rotatory power by rotating the driving member 306, and adjusts the inclination angle of the antenna using the generated rotatory power. Specially, the remote control unit is directly combined with the driving member 306 by inserted into the inserting section 310 without removing some of elements in the inclination angle adjusting apparatus 300. Hence, the inclination angle adjusting apparatus 300 of the present invention may more easily combine the remote control unit with the driving member 306 or separate the remote control unit from the driving member 306 than the inclination angle adjusting apparatus in related art.

In addition, since no element is removed when the remote control unit is combined with the driving member 306, the elements in the inclination angle adjusting apparatus 300 of the present invention may be not lost unlike in the inclination angle adjusting apparatus in related art.

Hereinafter, the phase shifter combined with the inclination angle adjusting apparatus 300 and for changing phase of corresponding signal will be described.

Figure 4:
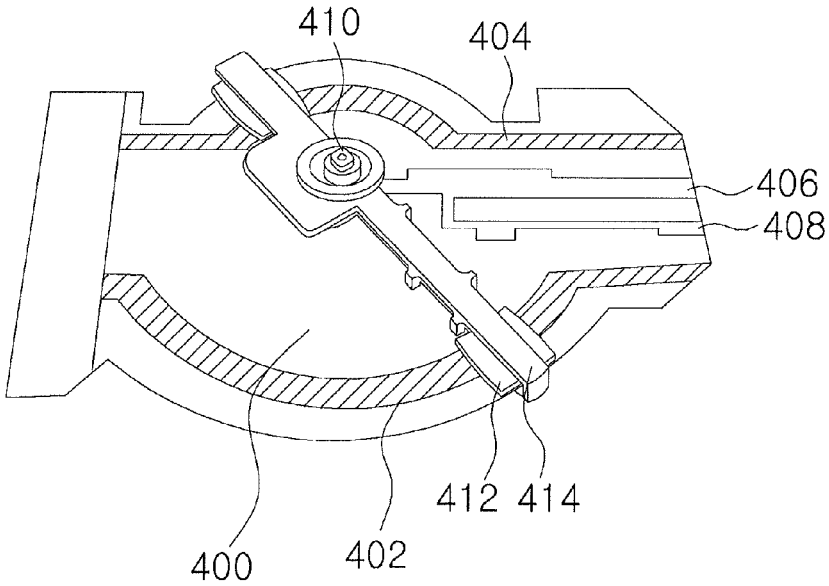
FIG. 4 is a top view illustrating a phase shifter according to one example embodiment of the present invention.
Figure 5:
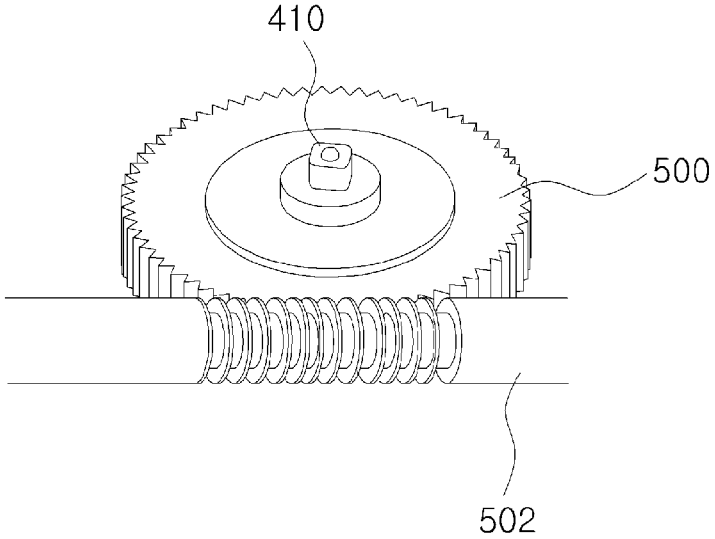
FIG. 5 is a perspective view illustrating a lower part of the phase shifter in FIG. 4.
Figure 6:
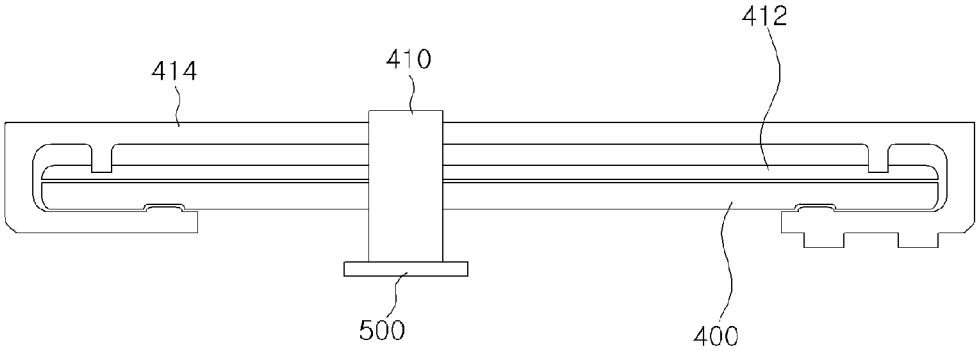
FIG. 6 is a sectional view illustrating schematically the phase shifter in FIG. 4.

FIG. 4 is a top view illustrating a phase shifter according to one example embodiment of the present invention. FIG. 5 is a perspective view illustrating a lower part of the phase shifter in FIG. 4. FIG. 6 is a sectional view illustrating schematically the phase shifter in FIG. 4.

In FIG. 4 and FIG. 5, the phase shifter of the present embodiment includes a dielectric substrate 400, a first line 402, a second line 404, an input line 406, an output line 408, a rotation axis member 410, an arm member 412, a guide member 414, a first rotation member 500 and a second rotation member 502.

The rotation members 500 and 502 located in a lower part of the phase shifter are combined with the members 400, 412 and 414 located in an upper part of the phase shifter as shown in FIG. 6.

Hereinafter, operation of the elements in the phase shifter will be described in detail.

The dielectric substrate 400 is made up of dielectric material having a certain dielectric constant. Here, a ground plate (not shown) is formed on a lower surface of the dielectric substrate 400 or in the dielectric substrate 400.

The first line 402 is a conductor, and is formed on the dielectric substrate 400 with for example curve shape. Here, ends of the first line 402 are electrically connected to some of radiation devices (not shown), e.g. a first radiation device and a second radiation device, which is not shown.

The second line 404 is a conductor, and is formed on the dielectric substrate 400 with for example curve shape. Here, ends of the first line 402 are electrically connected to some of the radiation devices, e.g. a third radiation device and a fourth radiation device, which is not shown.

The input line 406 is a conductor. Here, a RF signal is inputted to the input line 406.

Some of the inputted RF signal is outputted to a corresponding radiation device through a first dielectric substrate area located below the output line 408 without change of its phase. The other RF signal is coupled at the rotation axis member 410, and then is outputted to corresponding radiation devices through a second dielectric substrate area located below the arm member 412. As a result, an array antenna having the radiation devices radiates a given beam which is changed in response to phase change of the RF signal in accordance with transmission path of the RF signal.

The second rotation member 502 combines with the power delivering member 302 of the inclination angle adjusting apparatus 300, and rotates in response to the rotatory power delivered from the power delivering member 302.

The first rotation member 500 rotates in response to the rotation of the second rotation member 502. In one example embodiment of the present invention, the second rotation member 502 is a gear worm, and the first rotation member 500 is a gear wheel.

The rotation axis member 410 is connected to the first rotation member 500 located in the lower part of the phase shifter, and is connected to the arm member 412 and the guide member 414 located in the upper part of the phase shifter.

The rotation axis member 410 rotates in accordance with the rotation of the rotation members 500 and 502, and so the arm member 412 and the guide member 414 rotate in response to the rotation of the rotation axis member 410.

The guide member 414 is connected to the rotation axis member 410 and the arm member 412 as shown in FIG. 6, and delivers the rotatory power in accordance with the rotation of the rotation axis member 410 to the arm member 412. As a result, the arm member 412 rotates with guide member 414 in accordance with the delivered rotatory power.

In brief, the phase shifter is connected to the inclination angle adjusting apparatus 300, and controls the phase of the inputted RF signal in response to the rotatory power delivered from the inclination angle adjusting apparatus 300. As a result, direction of the beam outputted from the antenna is adjusted. That is, the inclination angle adjusting apparatus 300 provides the rotatory power to the phase shifter, thereby adjusting the inclination angle of the antenna.

The phase shifter of the present embodiment may be variously modified as long as the phase shifter uses the rotatory power delivered from the inclination angle adjusting apparatus 300, i.e. is not limited as structure in FIG. 4 to FIG. 6.

Hereinafter, structure of the inclination angle adjusting apparatus 300 will be described in detail with reference to accompanying drawings.

Figure 7:
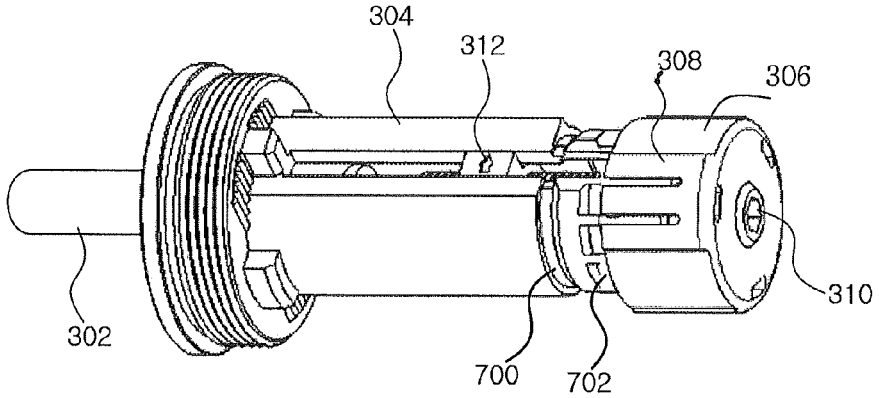
FIG. 7 is a perspective view illustrating the inclination angle adjusting apparatus in FIG. 3.

FIG. 7 is a perspective view illustrating the inclination angle adjusting apparatus in FIG. 3.

As shown in FIG. 7, a cylindrical home 700 and at least one imperfect cylindrical home 702 are formed on the body 304.

In case that the driving member 306 is combined with the cylindrical home 700 as shown in FIG. 3, the driving member 306 may rotate on the cylindrical home 700 due to characteristic of the cylindrical home 700. However, in case that the driving member 306 is combined with the imperfect cylindrical home 702 as shown in FIG. 7, the driving member 306 is fixed to the imperfect cylindrical home 702 without rotated.

In one example embodiment, at least one hook member is formed on the internal surface of the driving member 306, which is not shown. In this case, the hook member is hung at the imperfect cylindrical home 702, and so the driving member 306 is fixed to the body 304. As a result, the driving member 306 may be stably fixed to the body 304 though an external force such as impact, etc is generated.

In other words, a user combines the driving member 306 with the cylindrical home 700, and then rotates the driving member 306, thereby adjusting the inclination angle of the antenna. Subsequently, the user pulls the driving member 306 and combines the driving member 306 with the imperfect cylindrical home 702, thereby fixing the driving member 306 to the imperfect cylindrical home 702 so that the driving member 306 is not rotated by the external force. In case that the user wants to adjust again the inclination angle of the antenna, the user pushes the driving member 306 so that the driving member 306 is located on the cylindrical home 700.

In short, unlike the inclination angle adjusting apparatus in related art where the driving member is fixed by using extra members, the inclination angle adjusting apparatus 300 of the present embodiment fixes the driving member 306 through a simple method of pulling or pushing the driving member 306. Accordingly, extra member for fixing the driving member 306 is not needed in the inclination angle adjusting apparatus 300.

FIG. 8 is a perspective view illustrating an inclination angle adjusting apparatus according to one example embodiment of the present invention.

In FIG. 8, the inclination angle adjusting apparatus 300 of the present embodiment includes fixing members 802, 804 and 806 as well as the power delivering member 302, the body 304 and the driving member 306.

A projection member 800 is formed on an internal surface of the driving member 306 as shown in FIG. 8. An inserting section 808 is formed on an end of the power delivering member 302, wherein the projection member 800 is inserted into the inserting section 808. That is, the driving member 306 is combined with the power delivering member 302 by inserting the projection member 800 into the inserting section 808 when the inclination angle adjusting apparatus 300 is assembling.

In one example embodiment of the present invention, the projection member 800 has polygon shape so that the rotatory power generated by the driving member 306 is more delivered to the power delivering member 302. The inserting section 808 has also shape corresponding to the projection member 800, i.e. polygon shape.

The fixing member 802 combines with a thread 810 formed on an end of the body 304. Accordingly, in case that the driving member 306 is combined with the imperfect cylindrical home 702, the driving member 306 is not separated from the imperfect cylindrical home 702 by the fixing member 802 though the external force is generated. In other words, the fixing member 802 fixes the driving member 306, and thus structure corresponding to the thread 810 is formed on an internal surface the fixing member 802.

The fixing members 804 and 806 are combined with thread 812 formed on an outside surface of the power delivering member 302 so that the indicating member 312, etc is not separated by the external force.

As described above, the inclination angle adjusting apparatus 300 of the present embodiment rotates the driving member 306, thereby rotating the power delivering member 302. In other words, unlike the inclination angle adjusting apparatus in related art which moves linearly in accordance with operation of the driving member, the power delivering member 302 rotates in accordance with operation of the driving member 306 in the inclination angle adjusting apparatus 300 of the present invention. Here, the phase shifter operates in response to the rotation of the power delivering member 302 as mentioned above.

Additionally, the inserting section 310 is formed on the outside surface of the driving member 306, wherein the remote control unit is inserted into the inserting section 310. Hence, the inclination angle adjusting apparatus 300 of the present embodiment may combine the remote control unit with the driving member 306 without removal of certain members. Accordingly, the inclination angle adjusting apparatus 300 of the present invention may combine (separate) more easily with (from) the remote control unit than the inclination angle adjusting apparatus in related art.

In one example embodiment of the present invention, in case that the remote control unit is inserted into the inserting section 310 under the condition that the driving member 306 is fixed to the imperfect cylindrical home 702, the driving member 306 may be automatically separated from the imperfect cylindrical home 702 and then be combined with the cylindrical home 700.

Figure 9:
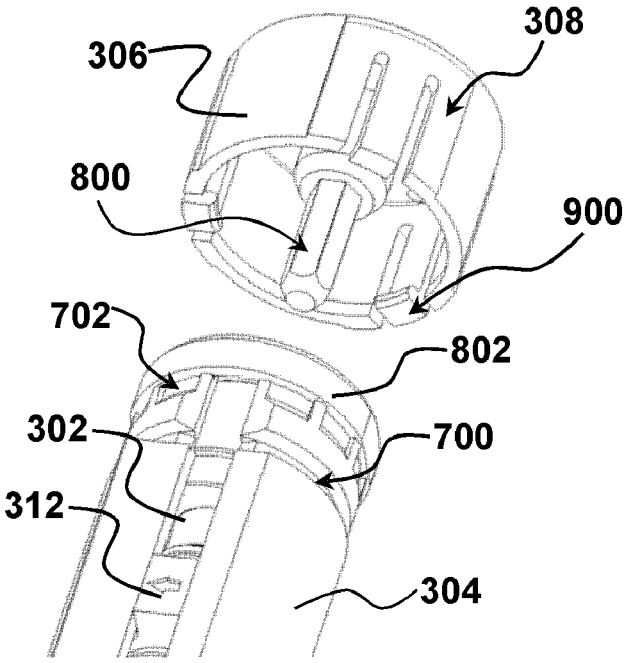
FIG. 9 is a perspective view illustrating internal structure of an inclination angle adjusting apparatus according to one example embodiment of the present invention.

FIG. 9 is a perspective view illustrating internal structure of an inclination angle adjusting apparatus according to one example embodiment of the present invention.

As shown in FIG. 9, at least one projecting member 308 is formed on the driving member 306 so that the user's hand does not slide. In addition, the projection member 800 for combining the driving member 306 with the power delivering member 302 is formed on an internal surface of the driving member 306. Here, shape of the projection member 800 may be variously modified. It is desirable that the projection member 800 has polygon shape so as to more deliver the rotatory power generated by the driving member 306 to the power delivering member 302.

At least one hook member 900 is formed on an end of the driving member 306 as shown in FIG. 9. The hook member 900 is combined with the cylindrical home 700 or the imperfect cylindrical home 702 of the body 304.

In one example embodiment of the present invention, number of the imperfect cylindrical homes 702 is greater than that of the hook members 900. For example, the imperfect cylindrical homes 702 has twice number than the hook members 900. This is because the hook members 900 combine more rapidly and easily with the imperfect cylindrical homes 702 as the number of the imperfect cylindrical homes 702 is increased.

In brief, the inclination angle adjusting apparatus 300 of the present embodiment combines the driving member 306 with the power delivering member 302 using the projection member 800, and fixes the driving member 306 to the body 304 using the hook member 900 and the homes 700 and 702. As a result, the inclination angle adjusting apparatus 300 may deliver more the rotatory power generated by the driving member 306 to the power delivering member 302, and fix the driving member 306 to the body 304 through the above simple method. Accordingly, the user may control easily the inclination angle adjusting apparatus 300.

Any reference in this specification to "one embodiment," "an embodiment," "example embodiment," etc., means that a particular feature, structure, or characteristic described in connection with the embodiment is included in at least one embodiment of the invention. The appearances of such phrases in various places in the specification are not necessarily all referring to the same embodiment. Further, when a particular feature, structure, or characteristic is described in connection with any embodiment, it is submitted that it is within the purview of one skilled in the art to affect such feature, structure, or characteristic in connection with other ones of the embodiments. Although embodiments have been described with reference to a number of illustrative embodiments thereof, it should be understood that numerous other modifications and embodiments can be devised by those skilled in the art that will fall within the spirit and scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

The invention claimed is:

1. An inclination angle adjusting apparatus in an antenna having a phase shifter, the inclination angle adjusting apparatus comprising:

a power delivering member connected to the phase shifter; and a driving member combined with the power delivering member, and configured to provide a power to the power delivering member; and a body configured to house the power delivering member, wherein the driving member is combined with the body, a first inserting section is formed on a part of outside surfaces of the driving member, a remote control unit is inserted into the first inserting section of the driving member and rotates the driving member, and the power delivering member rotates in response to the power provided from the driving member, at least one hook member is formed on an end of the driving member, and a cylindrical home and imperfect cylindrical homes are formed on an outside surface of the body, and wherein the driving member is rotated on the body when the hook member is combined with the cylindrical home, and the driving member is fixed to the body when the hook member is combined with the imperfect cylindrical home.

2. The inclination angle adjusting apparatus of claim 1, further comprising:

a fixing member combined with an end of the body so that the hook member is not separated from the imperfect cylindrical home by an outside force when the hook member is combined with the imperfect cylindrical home.

3. The inclination angle adjusting apparatus of claim 1, wherein the driving member has a projection member, and a second inserting section is formed on an end of the power delivering member, and wherein the projection member is inserted into the second inserting section when the driving member is combined with the power delivering member.

4. The inclination angle adjusting apparatus of claim 1, wherein the first inserting section has polygon shape.

5. The inclination angle adjusting apparatus of claim 1, wherein the hook member combined with the imperfect cylindrical home is automatically moved on the cylindrical home when the remote control unit is inserted into the first inserting section of the driving member.

6. The inclination angle adjusting apparatus of claim 1, wherein at least one sliding protection projection member is formed on the outside surface of the driving member.

7. The inclination angle adjusting apparatus of claim 1, wherein a thread is formed on a part of an outside surface of the power delivering member, and an indicating member for indicating change degree of an inclination angle is disposed on the thread.

8. The inclination angle adjusting apparatus of claim 1, wherein the rotatory power delivered from the driving member is provided to a phase shifter through the power delivering member, and the phase shifter adjusts an inclination angle of the antenna using the provided rotatory power.

9. The inclination angle adjusting member of claim 3, wherein the driving member has cylindrical shape, and the projection member is projected from an internal surface of the driving member.

10. The inclination angle adjusting apparatus of claim 3, wherein the projection member has polygon shape, and the second inserting section has shape corresponding to the projection member.

11. The inclination angle adjusting apparatus of claim 8, wherein the phase shifter includes:

a gear worm combined with the power delivering member; and a gear wheel connected to the gear worm and configured to rotate in accordance with operation of the gear worm, and wherein the inclination angle of the antenna is adjusted in accordance with rotation of the gear wheel.

* * * * *